US008710343B2

(12) United States Patent
Kellett et al.

(10) Patent No.: US 8,710,343 B2
(45) Date of Patent: Apr. 29, 2014

(54) MUSIC COMPOSITION AUTOMATION INCLUDING SONG STRUCTURE

(75) Inventors: Paul Kellett, Bremen (DE); Peter Gorges, Bremen (DE); Axel Hensen, Bremen (DE); Norman Schmielau, Bremen (DE)

(73) Assignee: Ujam Inc., Dover, DE (US)

( * ) Notice: Subject to any disclaimer, the term of this patent is extended or adjusted under 35 U.S.C. 154(b) by 348 days.

(21) Appl. No.: 13/175,422

(22) Filed: Jul. 1, 2011

(65) Prior Publication Data

US 2012/0312145 A1 Dec. 13, 2012

Related U.S. Application Data

(60) Provisional application No. 61/495,330, filed on Jun. 9, 2011.

(51) Int. Cl.
*G10H 7/00* (2006.01)

(52) U.S. Cl.
USPC ..... 84/610; 84/634; 84/650; 84/666; 700/94

(58) Field of Classification Search
USPC ..... 84/610, 666–669, 634–637, 650; 700/94
See application file for complete search history.

(56) References Cited

U.S. PATENT DOCUMENTS

| | | | | |
|---|---|---|---|---|
| 3,769,872 | A | 11/1973 | Andrews | |
| 5,736,664 | A * | 4/1998 | Ito et al. | 84/634 |
| 6,972,363 | B2 * | 12/2005 | Georges et al. | 84/609 |
| RE40,543 | E * | 10/2008 | Aoki et al. | 84/609 |
| 7,667,126 | B2 * | 2/2010 | Shi | 84/616 |
| 7,668,610 | B1 * | 2/2010 | Bennett | 700/94 |
| 7,705,229 | B2 | 4/2010 | Bancroft et al. | |
| 7,714,222 | B2 | 5/2010 | Taub et al. | |
| 7,790,974 | B2 | 9/2010 | Sherwani et al. | |
| 2004/0173082 | A1 | 9/2004 | Bancroft et al. | |
| 2006/0074649 | A1 * | 4/2006 | Pachet et al. | 704/229 |
| 2006/0075884 | A1 * | 4/2006 | Streitenberger et al. | 84/616 |
| 2006/0230909 | A1 * | 10/2006 | Song et al. | 84/609 |
| 2006/0230910 | A1 * | 10/2006 | Song et al. | 84/616 |
| 2008/0190272 | A1 | 8/2008 | Taub et al. | |
| 2009/0064851 | A1 * | 3/2009 | Morris et al. | 84/637 |
| 2009/0217805 | A1 * | 9/2009 | Lee et al. | 84/611 |
| 2010/0192755 | A1 * | 8/2010 | Morris et al. | 84/637 |
| 2010/0307321 | A1 * | 12/2010 | Mann et al. | 84/613 |
| 2011/0251842 | A1 * | 10/2011 | Cook et al. | 704/207 |

(Continued)

OTHER PUBLICATIONS

Peiszer, E., "Automatic Audio Segmentation: Segment Boundary and Structure Detection in Popular Music," Master's Thesis, Vienna Univ. of Technology, Aug. 2007, 114 pp.

(Continued)

*Primary Examiner* — David S. Warren
(74) *Attorney, Agent, or Firm* — Haynes Beffel & Wolfeld LLP

(57) ABSTRACT

A music composition automation system includes logic to assign metadata to an audio recording to divide a melody in the recording into sections, and to identify song form section types for the sections. In addition, logic to associate audio accompaniment with the sections based on the identified section types can be based on a style library, that is arranged to provide data executable by a data processing system to generate musical phrases associated with respective styles. Musical phrases in the style library include metadata specifying characteristics of the phrase according to song form section type.

26 Claims, 12 Drawing Sheets

(56) References Cited

U.S. PATENT DOCUMENTS

| | | | | |
|---|---|---|---|---|
| 2012/0118127 | A1* | 5/2012 | Miyajima | 84/612 |
| 2012/0180618 | A1* | 7/2012 | Rutledge et al. | 84/610 |
| 2012/0297958 | A1* | 11/2012 | Rassool et al. | 84/609 |
| 2012/0312145 | A1* | 12/2012 | Kellett et al. | 84/613 |
| 2013/0025437 | A1* | 1/2013 | Serletic et al. | 84/634 |

OTHER PUBLICATIONS

Shag, X., "Automatic Music Summarization Based on Music Structure Analysis," IEEE Int'l Conf. on Acoustics, Speech and Signal Processing (ICASSP), vol. 2, Mar. 18-23, 2005, 4 pp.

Band-In-A-Box, v. 2009.5 for Windows, PG Music Inc. License Agreement and Owner's Manual, PG Music Inc. copyright 1989-2009, 511 pp.

Maddage,N.C., "Automatic Structure Detection for Popular Music," Multimedia, IEEE, vol. 13(1), Jan. 2006, pp. 65-77.

Eronen, A., "Chorus Detection with Combined Use of MFCC and Chroma Features and Image Processing Filters," Proc. of the 10th Int. Conference on Digital Audio Effects (DAFx-07), Bordeaux, France, Sep. 2007, 8 pp.

Temperley, D., The Cognition of Basic Musical Structures, Section I (Chapters 2-7), pp. 23-201, MIT Press, Cambridge, MA, paperback ed. 2004.

* cited by examiner

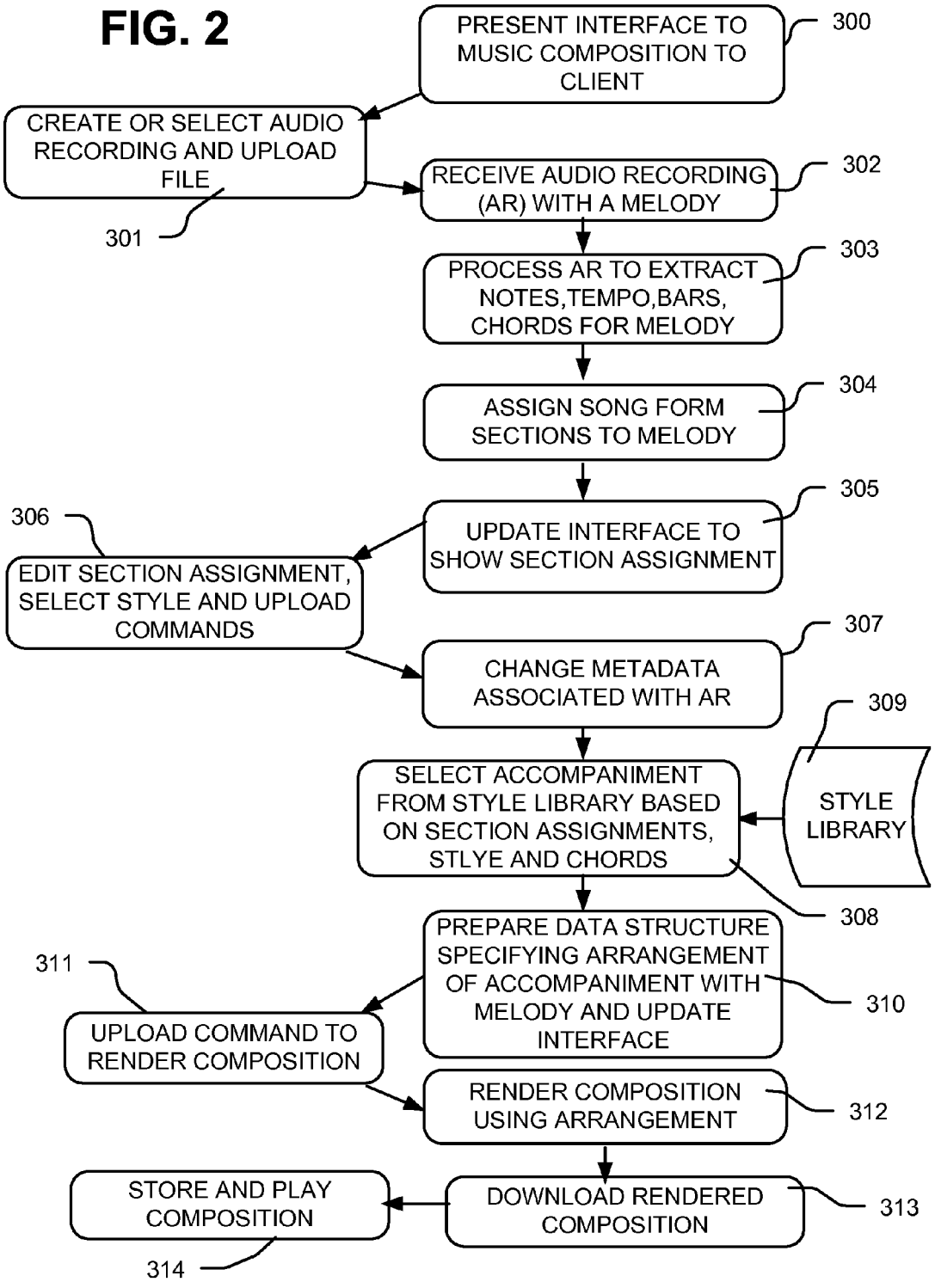
FIG. 2
PRESENT INTERFACE TO MUSIC COMPOSITION TO CLIENT
300
CREATE OR SELECT AUDIO RECORDING AND UPLOAD FILE
301
RECEIVE AUDIO RECORDING (AR) WITH A MELODY
302
PROCESS AR TO EXTRACT NOTES,TEMPO,BARS, CHORDS FOR MELODY
303
ASSIGN SONG FORM SECTIONS TO MELODY
304
UPDATE INTERFACE TO SHOW SECTION ASSIGNMENT
305
306
EDIT SECTION ASSIGNMENT, SELECT STYLE AND UPLOAD COMMANDS
CHANGE METADATA ASSOCIATED WITH AR
307
309
SELECT ACCOMPANIMENT FROM STYLE LIBRARY BASED ON SECTION ASSIGNMENTS, STLYE AND CHORDS
STYLE LIBRARY
308
PREPARE DATA STRUCTURE SPECIFYING ARRANGEMENT OF ACCOMPANIMENT WITH MELODY AND UPDATE INTERFACE
310
311
UPLOAD COMMAND TO RENDER COMPOSITION
RENDER COMPOSITION USING ARRANGEMENT
312
STORE AND PLAY COMPOSITION
DOWNLOAD RENDERED COMPOSITION
313
314

| Field | Type | Description |
|---|---|---|
| name | text | User-editable name (initial value set automatically) |
| section_type | enumeration | Not Set, Intro 1, Intro2, Verse1, etc... |
| tempo | float | Tempo in quarternote beats per minute |
| beats_per_bar | float | Bar length in quarternotes (e.g. 4.0 for 4/4 time signature) |
| key | integer | 0=Cmaj/Amin, 1=$D^{\flat}$maj/$B^{\flat}$min, 2=Dmaj/Bmin ... 11=Bmaj/$A^{\#}$min |
| chords | list of beats,name | Length in quarternote beats and chord name for each chord in sequence |

FIG. 5

| | |
|---|---|
| name | "" |
| section_type | Chorus 1 |
| tempo | 120.0 |
| beats_per_bar | 4.0 |
| key | 0 |
| chords | 4.0 Cmaj, 4.0 Fmaj, 4.0 Amin, 4.0 Gmaj, 4.0 Cmaj, 4.0 Fmaj, 4.0 Amin, 4.0 Gmaj, 4.0 Cmaj, 4.0 Fmaj, 4.0 Amin, 4.0 Gmaj, 4.0 Cmaj, 4.0 Cmaj, 4.0 Gsus4, 4.0 Gmaj |

FIG. 6

| | |
|---|---|
| name | "Intro" |
| section_type | Intro 1 |
| tempo | 120.0 |
| beats_per_bar | 4.0 |
| key | 0 |
| chords | 4.0 Cmaj |
| name | "Verse" |
| section_type | Verse 1 |
| tempo | 120.0 |
| beats_per_bar | 4.0 |
| key | 0 |
| chords | 4.0 Cmaj, 4.0 Fmaj, 4.0 Amin, 4.0 Gmaj,<br>4.0 Cmaj, 4.0 Fmaj, 4.0 Amin, 4.0 Gmaj |
| name | "Chorus" |
| section_type | Chorus 1 |
| tempo | 120.0 |
| beats_per_bar | 4.0 |
| key | 0 |
| chords | 4.0 Cmaj, 4.0 Fmaj, 4.0 Amin, 4.0 Gmaj,<br>4.0 Cmaj, 4.0 Cmaj, 4.0 Gsus4, 4.0 Gmaj |
| name | "Ending" |
| section_type | None |
| tempo | 120.0 |
| beats_per_bar | 4.0 |
| key | 0 |
| chords | 4.0 Cmaj, 4.0 Cmaj, 4.0 Cmaj, 4.0 Cmaj |

FIG. 7

| Field | | | Type | Description |
|---|---|---|---|---|
| Name | | | text | Name displayed to user |
| Description, Genre, Decade, Keywords ... | | | text | Various metadata for sorting/filtering/selecting styles |
| For Each Instrument In Style | Name | | text | Name displayed to user |
| | Type | | text | Metadata for sorting/filtering/selecting style instruments |
| | Retrigger | | boolean | Phrases should restart on each new chord |
| | ChordMask | | integer | Bit mask of available chord types ( 0 = unpitched) |
| | BassNotChord | | boolean | Pitch should follow bass note of chord rather than root note |
| | KeyNotChord | | boolean | Pitch should follow root note of song key rather than chord |
| | For Each Song Section Type | phrase | integer | Phrase to loop during song section (0 = none) |
| | | start_level | float | Volume at start of song section |
| | | end_level | float | Volume at end of song section |
| | | trig_phrase | integer | Phrase to trigger at start or end of section (0 = none) |
| | | trig_beat | float | Beats before end of section to play trig_phrase (0.0 = play at start of section) |

FIG. 8

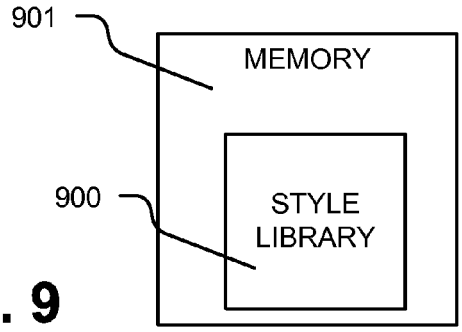

FIG. 9

MUSIC COMPOSITION AUTOMATION INCLUDING SONG STRUCTURE

Benefit of U.S. Provisional Application No. 61/495,330, filed 9 Jun. 2011 is claimed.

BACKGROUND OF THE INVENTION

1. Field of the Invention

The present invention relates to technology for computer-based, musical composition automation.

2. Description of Related Art

Songs include a melody comprising a succession of notes having a tempo, and accompaniment that can include chords arranged with the notes of the melody. The accompaniment typically is played using instrumental phrases which characterize a chosen style of music. The process of composing of songs can be very complex, given the range of choices presented.

Technology to assist the musical composition has been developed that provides tools for creation and editing of songs. See, U.S. Pat. No. 7,790,974, entitled METADATA-BASED SONG CREATION AND EDITING, by Sherwani et al. However, the variety of musical styles, instruments, phrasings and so on that can be applied to a composition makes the technological problem of providing good sounding accompaniment very difficult.

Typical consumers using these prior art technologies have difficulty creating good sounding music. As a result, products in this field have had only limited success. It is desirable therefore provide solutions to the problem of automatically analyzing an input audio file that includes a melody, and of creating good sounding accompaniment for the melody. It is also desirable to provide solutions to the problem of producing data that can characterize an input audio file in terms of the structure of a melody in the recording, in order to facilitate computer-assisted, music composition automation.

SUMMARY

Technologies are described here for automatically characterizing an input audio file for use in music composition automation, and for providing accompaniment for a melody in the input audio file. The technologies include techniques for splitting a melody or audio recording into song form sections, for assigning a type to each section, and for automatically providing musical accompaniment based on the assigned sections and section types. The technology can be applied to produce a composition including a melody with accompaniment that varies in an interesting and relevant way through the course of the song.

BRIEF DESCRIPTION OF THE DRAWINGS

FIG. 2 is a flow diagram for a music composition automation process.

FIG. 5 illustrates the organization of the data structure for a song section utilized in a music composition automation process described herein.

FIG. 6 illustrates an instance of a data structure such as that of FIG. 5 for an input audio file, before it is divided into sections.

FIG. 7 illustrates one representative instance of results of dividing the audio file characterized by the structure of FIG. 6, into song form sections as described herein.

FIG. 8 illustrates the organization of the data structure for a style entry in a music style library, including executable data for providing accompaniment according to song form section.

FIG. 9 represents a product comprising a style library usable in music composition automation, including executable data for associating musical accompaniment for a melody, with song form section information.

DETAILED DESCRIPTION

Figure 1:
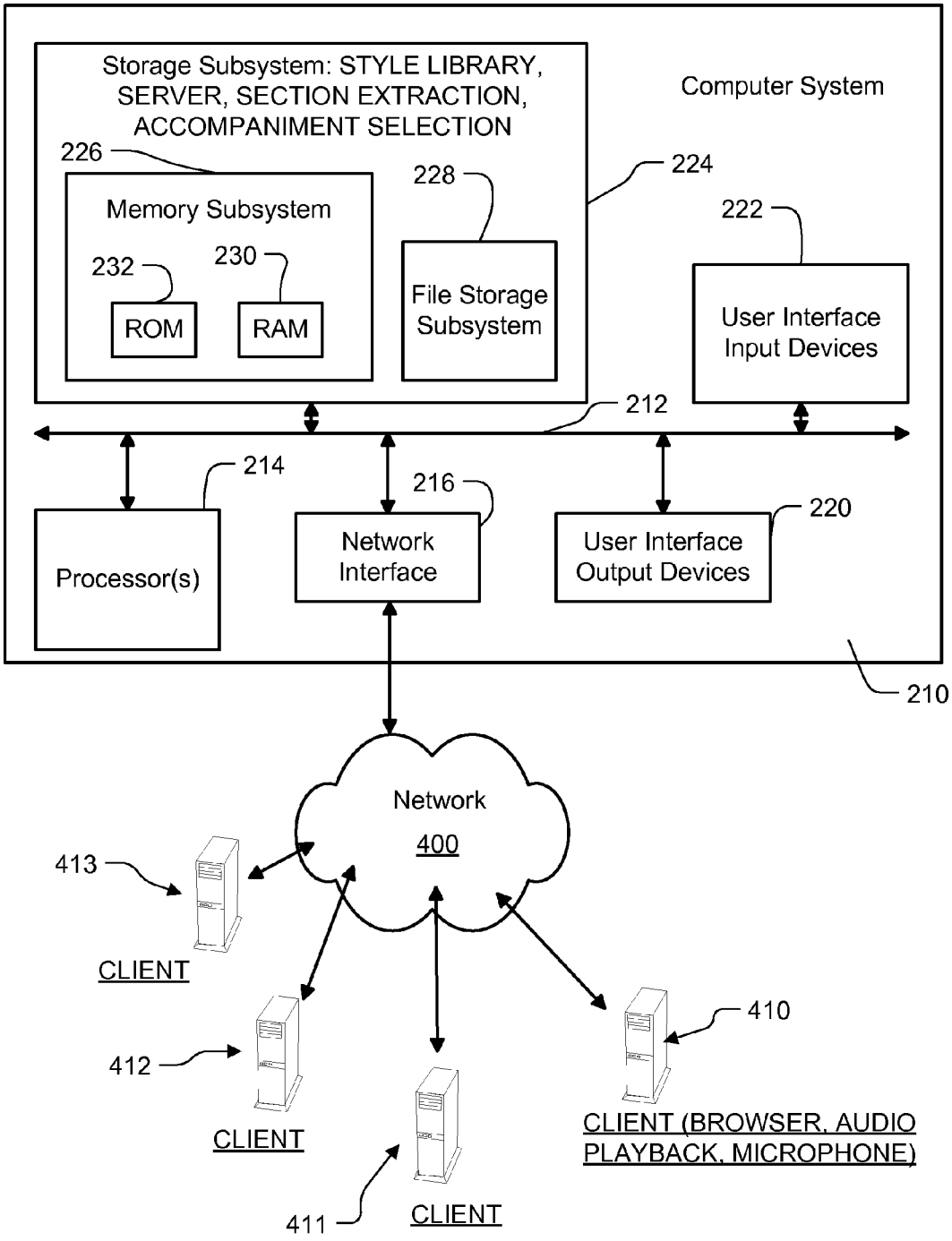
FIG. 1 is a simplified diagram of a data processing system implementing music composition automation as described herein.

Most popular songs consist of sections (verse, chorus, etc.), where the musical accompaniment varies in each type of section. A typical short song might consist of the following song form sections: Intro, Verse 1, Chorus, Verse 2, Chorus, Chorus, Ending. A song section comprises a set of more than one sequential bars of a melody, which can be grouped, and have a type that corresponds with the kind of musical accompaniment to be applied. Thus different section types for a song form sections can be characterized by different rules for the assignment of the accompaniment. For example, in some sections, the number and selection of instruments and instrument phrases, used for accompaniment with the melody can be different than the number and selection of instruments and instrument phrases used with a melody in different types of sections. Also, the types of phrasing used can vary among section types.

The following set of song form section types typically can provide enough scope for reproducing popular songs with good fidelity:

Short Intro (a "pickup" into the following section that may only be a few beats long)

Long Intro (typically a repeating phrase, similar to the verse, that may fade in over the length of the section)

Verse 1 |

Verse 2 |

Variation 1 |Increasing energy or intensity

Variation 2 |

Chorus 1 |

Chorus 2 V

Short Ending (typically all instruments play a sustained note, at or near the start of the section, then stop)

Long Ending (typically a repeating phrase, similar to the chorus that fades out over the length of the section)

All or some of these section types can be used as a default setting in the section assignment process herein. Most songs do not contain every type of song section. For example if all choruses have a similar intensity then Chorus 1 can be used a number of times in the song. Some songs contain a "bridge" or "breakdown" section with significantly different accompaniment to the other section. Here a Variation section can be used. There will always be certain songs with special features that do not map easily to a selected set of sections, but that is more a matter of a particular arrangement than of the song itself The method described here is flexible enough to apply any style of music to any arrangement of song sections and produce reasonable, musical results.

The automatic song structure (or song form) is based on a melody, or an audio recording which has been analyzed to extract the "melody" (events with pitch and duration arranged on a beat grid). A melody can be based on audio recordings of singing, rapping, beatboxing, musical instrument performances and other audio signals with identifiable events. There may be more than one melody or recording, sequential or overlapping, but for the purposes of applying automatic song structure described below, these can be considered to have been merged into a single sequence which will be referred to below as "the melody". Initially the whole length of the melody can be considered to be one long "Chorus 1" section.

The melody can be characterized by a data structure that includes the audio file, and metadata including a list of notes, each with the following properties:

- start position in beats, relative to the start of the song
- length in beats
- pitch of the note (using for example, the MIDI standard, where semitone number 60 is middle C)

Given a tempo and number of beats per bar for the song, melody note positions and lengths can be freely converted between time in seconds, position in beats, or position in bars and beats. The audio file can include a recording in any computer readable format, such as WAV, AIFF, MP3 and FLV format files.

If the total length of the melody is 12 bars or more, then in one embodiment it is split into multiple sections of 6 to 12 bars in length. In the absence of any information to the contrary from the melody itself, each section can be 8 bars long, as this is the most common length in popular songs (the last section may end up with an odd length such as 11 bars but this does not usually sound like a "mistake" when listening to the resulting song, so can be retained). In the absence of any information to the contrary from the melody itself, the section types can be assigned in the following sequence: Verse 1, Chorus 1, Verse 2, Variation 1, Chorus 2, Variation 2, Chorus 2 (repeat as necessary if there are more than 7 sections). Then, in one embodiment, the last section is always assigned to be Chorus 2.

A number of measures can be applied to the melody to extract information to help decide the section boundaries and types. Each measure is usually not conclusive by itself, but in combination may provide a strong enough hint to deviate from the default splitting described above (it typically should be a strong hint, as splitting a song which should have 8 bar sections into different length sections will usually sound worse than splitting a song that should have different length sections into the default 8-bar sections). Measures include:

- Choruses are louder than verses
- Choruses include larger musical intervals than verses
- Choruses include higher notes than verses.
- The longest inter-onset intervals in the melody may be close to section boundaries
- Phrases in the melody will be repeated in sections of the same type It has been observed that the last measure, "self-similarity," may be reliable on its own. Measuring "self-similarity" through the melody can detect repeats of a similar phrase during the melody. If repeats are separated by 2 or 4 bars then both repeats are likely to be in the same section. If the repeats are separated by 12 or more bars then both repeats are likely to be in different sections of the same type. Self-similarity can be measured in the following way: For each region of the melody 'A' (say a 1-bar length) compare to each later region in the melody 'B' by offsetting the pitch of A to minimize the overall pitch differences between A and B, then summing the difference in pitch between A and B over their length. In this way, regions that are playing similar pitch intervals at similar positions in the bar will be detected as having a high similarity, but small differences in timing or accidental notes will not have much effect. It may be desirable to weight differences in pitch lower than differences in position, as phrases are often repeated with a similar rhythmic pattern but different notes.

Self-similarity can be measured for each bar of the melody, but it could also work with 2-bar sections, or other combinations. Comparing longer sections like 4 bars may not work so well because there is more chance of differences (intentional or random) between say the first and second verse, whereas it is likely that at least one bar in both verses will be very similar. There are 2 separate parameters for the measurement of self-similarity: The interval along the melody each comparison takes place, and the length of material included in each comparison. Shorter-scale similarities or similarities separated by distances other than a whole number of bars, might not be relevant to section assignment. An alternative type of self-similarity measure which might produce good results is to use the front-end of a speech recognition system to convert the recording to a sequence of phonemes, MFCCs or similar, and find regions of high similarity. In typical songs the melody is similar in all sections of the same type, but song lyrics are typically different in each verse section, but very similar in each chorus section, therefore a sequence that has near-repeats at different points in the recording is likely to be the chorus.

Information learned by analysis of the audio file can be applied to adjust the section assignment using rules that can be empirically derived.

In one embodiment, an introduction section and ending section are always added, as additional sections in the file with the melody. In one embodiment, by default a Short Intro and a Short Ending are picked. If the total length of the melody is long (more than 16 bars) then the Long Ending is picked. If you the total length of the melody is long and the first note of the melody occurs in the second half of a bar, then the Long Intro is picked and the melody is aligned so it starts in the last half of the last bar of the intro (as a "pickup" into the next section).

Song sections do not have to be created automatically for the purpose of the assignment of accompaniment as described herein. Rather, the section assignment can be created in response to commands received via a user interface, or otherwise. In systems implementing automatic assignment of sections and section types, the results can be edited. Normal editing operations include:

- Changing the type of a section
- Moving the boundary (i.e. starting or ending bar of a section) between two sections to a different bar
- Splitting a section into two at a specified bar position
- Changing the length of the intro or ending (or removing them)

Other editing operations such as deleting or duplicating sections are not purely editing the song structure but also edit the melody itself, and likewise edits to the melody such as deleting a short section should affect the length of the song section containing that part of the melody. Boundaries between song sections are linked to positions along the melody.

Given an audio recording having a melody divided into sections, and section types, accompaniment can be produced using the technology here. Each musical style of accompaniment can be represented in a style library based on one or more instruments. Each instrument can be represented in the style library by a range of preset phrases it can play (in the current key/chord for pitched instruments) for a given style. To create realistic song arrangements, each instrument may have the predefined settings for each type of song section in a given style, including:

- Which phrase to play during the section (if any).
- Should the volume fade in or out during the length of the section.
- An overall volume trim for the section.
- Should the phrase play once at the start of the section, or repeat for the whole length.
- Should another phrase be played during the last N beats of the section (where N can be specified).
- Whether the same phrase was being played in the previous section or not, phrases are played from the beginning when a new section starts, allowing the previous section to have an odd length (not a multiple of the phrase length(s)) without disrupting the flow of the song.

A data structure to implement one example of the settings for instruments in a style can be understood with reference to FIG. 8, described below. An entry or entries in a style library identifies a number of instruments to play in the song on a section by section basis. Each instrument (which may all be from one style or a user-created mixture from different styles) can be represented by a set of phrases to play during a section. The process uses the above settings to decide what to play in the start, middle and end of each section. As each instrument has its own settings for each style and section type, this results in complex and realistic musical arrangements that fit the instrument and style of music being played, for any sequence of song sections.

In one embodiment, to play a style to accompany a melody or audio recording, a list of instructions for each instrument in the style is generated, based on the song section data (which can be derived from the melody) and the musical style data. Each instruction can have a timestamp measured in beats relative to the start of playback. Instructions can include:

- Select a specified phrase
- Play the phrase once only, or repeat it when the end is reached
- Play specified chord using the currently selected phrase
- Change volume to specified level over a specified number of beats The resulting list of instructions for each instrument can be independent of the technology used to generate audio playback for the instrument, for example the instructions could be translated to MIDI and sent to a MIDI synthesizer for playback.

In one implementation, a series of audio buffers are filled with the audio playback of each instrument. First, the buffer is split if necessary at positions corresponding to the beat positions in the list of instructions. The resulting series of buffers are sent to the instrument playback renderer with the instructions inserted at the relevant split points. The instrument playback renderer fills the buffer with an audio signal based on the currently selected phrase, chord and volume. The audio signal is based on a set of audio files saved on disk for each instrument, with embedded metadata to decide how the audio file data should be played back (length in beats, position of transients in file, etc.). The audio files can have a naming convention such as:

[style name]/[instrument name]/[instrument name] [section name] [chord name].wav For example, a file name can be: "Hard Rock/Rock Bass/Rock Bass Intro 1 Cmaj.wav". To find the relevant files during playback, a pre-prepared text file having a known organization, or other data structure readable by the rendering engine, can be used to map the phrase number, chord type and chord root note to the matching audio file name.

As a result of procedures described above, a musical composition can be automatically parsed and analyzed, and accompaniment can be automatically assigned. A basic process flow for music composition automation can be characterized by the following outline:

- if no melody existing yet
  - analyse pitch, periodicity and volume of audio recording
  - identify regions of steady pitch
  - interpret regions above minimum length as melody notes
  - find a grid that intercepts the most melody note start times
  - decide the tempo and bar positions from the grid
  - convert the note positions and lengths from time to beats
- add intro
  - if melody is long and first note of melody is in 2nd half of a bar
    - select longer intro, and overlap that half bar with the end of the intro
- add ending
  - if melody is long
    - select longer ending (fade-out)
- if melody longer than 12 bars
  - split into regions of 6 to 12 bars each
    - look for longest inter-onset intervals (pauses)
    - measure self-similarity across melody
    - prefer 8 bar sections, to reduce false-positive detection of other lengths
- playback
  - for each instrument in the selected musical style
    - for each song section
      - look up what musical phrase(s) to play in section, depending on section type
- allow manual editing and playback until the user is satisfied with the result FIG. 1 illustrates a data processing system configured for computer assisted automation of musical composition such as described herein, arranged in a client/server architecture.

The system includes a computer system 210 configured as a server including resources for assigning song form sections in an audio recording, and for associating audio accompaniment with the audio recording in response to the assigned sections. In addition, the computer system 210 includes resources for interacting with a client system (e.g. 410) to carry out the process in a client/server architecture.

Computer system 210 typically includes at least one processor 214 which communicates with a number of peripheral devices via bus subsystem 212. These peripheral devices may include a storage subsystem 224, comprising for example memory devices and a file storage subsystem, user interface input devices 222, user interface output devices 220, and a network interface subsystem 216. The input and output devices allow user interaction with computer system 210. Network interface subsystem 216 provides an interface to outside networks, and is coupled via communication network 400 to corresponding interface devices in other computer systems. Communication network 400 may comprise many interconnected computer systems and communication links. These communication links may be wireline links, optical links, wireless links, or any other mechanisms for communication of information. While in one embodiment, communication network 400 is the Internet, in other embodiments, communication network 400 may be any suitable computer network.

User interface input devices 222 may include a keyboard, pointing devices such as a mouse, trackball, touchpad, or graphics tablet, a scanner, a touchscreen incorporated into the display, audio input devices such as voice recognition systems, microphones, and other types of input devices. In general, use of the term "input device" is intended to include possible types of devices and ways to input information into computer system 210 or onto communication network 400.

User interface output devices 220 may include a display subsystem, a printer, a fax machine, or non-visual displays such as audio output devices. The display subsystem may include a cathode ray tube (CRT), a flat-panel device such as a liquid crystal display (LCD), a projection device, or some other mechanism for creating a visible image. The display subsystem may also provide non-visual display such as via audio output devices. In general, use of the term "output device" is intended to include all possible types of devices and ways to output information from computer system 210 to the user or to another machine or computer system.

Storage subsystem 224 includes memory accessible by the processor or processors, and by other servers arranged to cooperate with the system 210. The storage subsystem 224 stores programming and data constructs that provide the functionality of some or all of the processes described herein. Generally, storage subsystem 212 will include server management modules, a style library as described herein, programs for identification of song form sections, programs for selection of accompaniment using the style library were otherwise, and other programs and data utilized in the automated music composition technologies described herein. These software modules are generally executed by processor 214 alone or in combination with other processors in the system 210 or distributed among other servers in a cloud-based system.

Memory used in the storage subsystem can include a number of memories arranged in a memory subsystem 226, including a main random access memory (RAM) 230 for storage of instructions and data during program execution and a read only memory (ROM) 232 in which fixed instructions are stored. A file storage subsystem 228 can provide persistent storage for program and data files, and may include a hard disk drive, a floppy disk drive along with associated removable media, a CD-ROM drive, an optical drive, or removable media cartridges. The modules implementing the functionality of certain embodiments may be stored by file storage subsystem in the storage subsystem 224, or in other machines accessible by the processor.

Bus subsystem 212 provides a mechanism for letting the various components and subsystems of computer system 210 communicate with each other as intended. Although bus subsystem 212 is shown schematically as a single bus, alternative embodiments of the bus subsystem may use multiple busses. Many other configurations of computer system 210 are possible having more or less components than the computer system depicted in FIG. 1.

The computer system 210 can comprise one of a plurality of servers, which are arranged for distributing processing of data among available resources. The servers include memory for storage of data and software applications, and a processor for accessing data and executing applications to invoke its functionality.

The system in FIG. 1 shows a plurality of client computer systems 410-413 arranged for communication with the computer system 210 via network 400. The client computer system 410 can be of varying types including a personal computer, a portable computer, a workstation, a computer terminal, a network computer, a television, a mainframe, a smartphone, a mobile device, or any other data processing system or computing device. Typically the client computer system 410-413 will include a browser or other application enabling interaction with the computer system 210, audio playback devices which produce sound from a rendered composition, and audio input devices such as a microphone which provide input audio data or files that can be utilized in the composition of music. In some embodiments, a client computer system 410-413 includes audio input devices such as a keyboard, other electronic audio input devices, audio synthesis sources, and the like, which can be applied to produce audio data used in the composition process.

In a client/server architecture, the computer system 210 provides an interface to a client via the network 400. The client executes a browser, and renders the interface on the local machine. For example, a client can render a graphical user interface in response to a webpage, programs linked to a webpage, and other known technologies, delivered by the computer system 210 to the client 410. The graphical user interface provides a tool by which a user is able to receive information, and provide input using a variety of input devices. The input can be delivered to the computer system 210 in the form of commands, data files such as audio recordings, parameters for use in performing the automated composition processes described herein, and the like, via messages or sequences of messages transmitted over the network 400.

In one embodiment, a client interface for the music composition automation processes describe here can be implemented using Flash and run in a browser. The client communicates with an audio render server that gets selected based on the region the user logs in from. The amount of audio servers per region is designed to be scalable by making use of cloud computing techniques. The different protocols that get used for communication with the servers can include RPC, streaming via Realtime Messaging Protocol (RTMP) with data encoded in AMF (Action Message Format), and REST via HTTP with data encoded as JSON/XML.

Although the computing resources are described with reference to FIG. 1 as being implemented in a distributed, client/server architecture, the technologies described herein can also be implemented using locally installed software on a single data processing system including one or more processors, such as a system configured as a personal computer, as a workstation or as any other machine having sufficient data processing resources. In such system, the single data processing system can provide an interface on a local display device, and accept input using local input devices, via a bus system, like the bus subsystem 212, or other local communication technologies.

FIG. 2 is a simplified flowchart showing steps applied in a musical composition process as described herein, in one representative sequence. The order of the steps shown in FIG. 2 is merely representative, and can be rearranged as suits a particular session or particular implementation of the technology.

The sequence shown in FIG. 2 begins with presenting an interface on a client system prompting music composition (300). This can be presented on a local interface, or in a client/server architecture as mentioned above. An interface as described herein provides a means for prompting a client to begin the session, and for uploading an audio recording created or selected by the client. Thus, the client using the interface can create or select an audio recording, and upload the file to the server (301). At the server, the audio recording is received and stored, in whole or in part, for processing (302). The audio recording is processed to identify notes, tempo, bars and chords which characterize a melody in the recording (303). Metadata is associated with the audio recording based on the identified characteristics of the melody, that can be edited during the process of musical composition, and that can be used in rendering a new composition based on the melody.

The audio file and associated metadata is then processed to identify sections of the melody, and song form section types for the identified sections (304). One example procedure for identifying sections of the melody and song form section types can be understood with reference to FIG. 3. Next, the interface on the client system can be updated to show the section assignment (305).

The updated interface on the client that shows the section assignment, also provides tools for editing the section assignment, to select a musical style, and to upload commands to the server as a result of the editing and selecting steps (306). The server receives commands from the client and changes the metadata associated with the audio recording in response (307). When the client has indicated that the editing has completed, or that the client is otherwise ready to proceed with the composition process, the server performs a procedure to select accompaniment for the audio recording based on the section assignment, and other metadata associated with the audio file, including the selected musical style, optionally the chords, notes, tempo and so on (308). In a system described herein, the accompaniment is selected from a style library (309). The style library can be comprised of sets of instruments, and phrases played by the instruments, which are composed according to particular styles of music. Entries in the style library can include a pre-recorded audio file, along with metadata used in the selection process and used in the manner in which the phrases are combined with the bars in the melody.

After selecting accompaniment for the audio recording, the server can prepare a data structure specifying arrangement of the selected accompaniment with the melody, and update the user interface to indicate the status of the procedure, and to present tools for prompting further action (310). A user interacting with the interface can upload commands to render the composition (311). In response to such a command, the server can render the composition using the arrangement identified in the data structure produced in step 310 (312). Next, the server can download the rendered composition to the client (313), where the client can store and play the composition (314).

Figure 3:
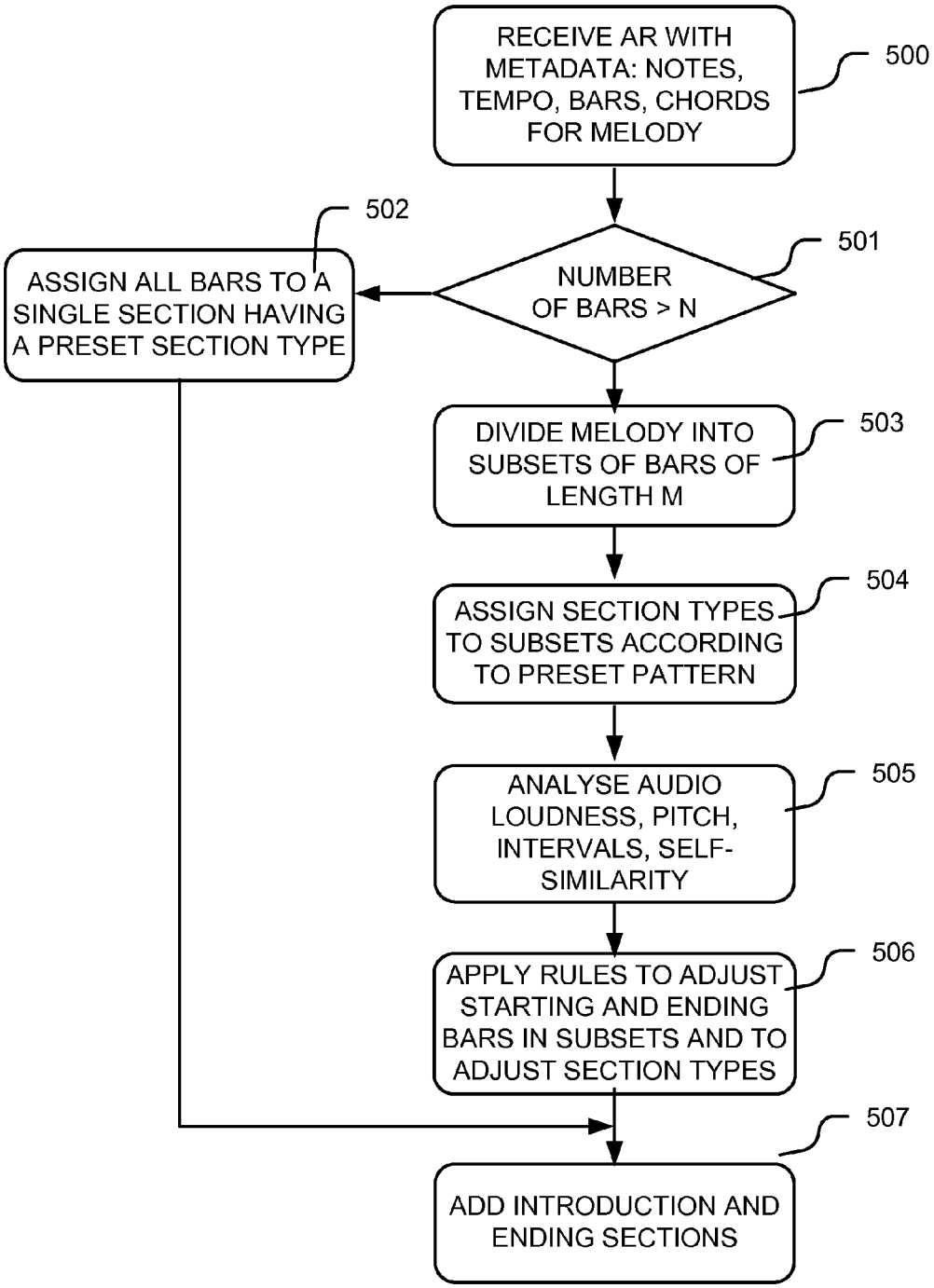
FIG. 3 is a flow diagram for a process of dividing a melody into sections and assigning section types.

FIG. 3 is a simplified flowchart showing one representative sequence for assigning song form section types to a melody which can be applied in a musical composition process, like that described with reference to FIG. 2 in step 304. The order of the steps shown in FIG. 3 is merely representative, and can be rearranged as suits a particular session or particular implementation of the technology.

The sequence is shown in FIG. 3 begins with receiving an audio recording including metadata that identifies at least the bars in the melody, and preferably additional information including the notes, tempo, chords and so on (500). The next step, the algorithm determines whether the number of bars in the melody is sufficient to be effectively divided into song form section. In one example, the sequence can determine whether the number of bars exceeds a fixed integer N, such as 12 (501). If the melody is too short, then the song can be considered a single section with an arbitrary or preset section type (502). If the melody includes a sufficient number of bars, then the sequence can divide the melody into sections having a fixed length M in bars. In one example, the fixed length M can equal eight bars (503). The sections can be defined the beginning with the first bar in the melody, and assigning the first M bars to a first section, the second M bars to a second section and so on. Any remainder of bars that is less than M can be appended to the final section. Once the melody is divided into sections of bars, the process can assigned section types to the sections according to a preset pattern, that corresponds with the section organization of a chosen, common song form (504). Additional processing can be performed based on the notes or other musical content of the audio file. In procedures using this additional processing, the audio file is analyzed to determine characteristics of the components of the melody, including for example loudness, pitch, intervals, similarity of a given note with other notes in the melody having particular temporal relationships (505). Using the results of this analysis, rules can be applied to just the starting and ending bars in the sections of bars that have been identified, and to change the section types associated with a given section (506). Finally, in some embodiments, the process of assigning section types (e.g. after the steps of blocks 502 or 506) can include adding introduction and ending sections to the melody (507).

Figure 4A:
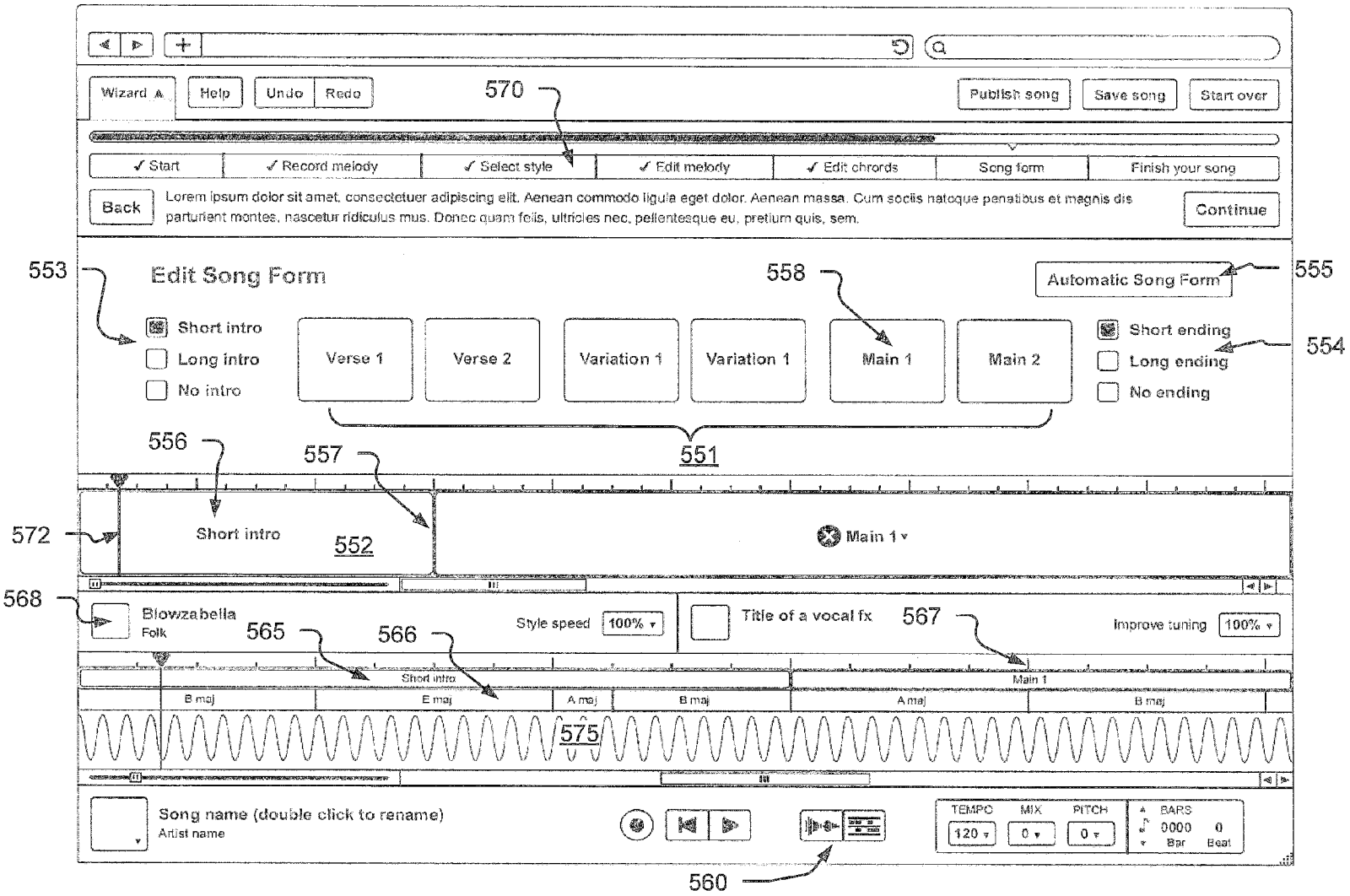
FIGS. 4A-4F illustrate graphic user interface pages which can be implemented to support the music composition automation processes, such as illustrated with respect to FIG. 2 and FIG. 3.

FIG. 4A illustrates a graphical user interface for a song form editor 570 that can be utilized by a user to operate on the melody or audio recording file, while interacting with a server that provides the interface. In this example, the interface includes a list 551 of song form sections, displaying the standard section types available. In this example, the "main" section types correspond with a chorus. Each section type has a button 558 associated with it, used for selecting and identifying the section type during editing operations. In the region 572, song sections are displayed using a construct suitable for performing edit operations. For example, in the region 552, an introduction section is represented, and has a label 556 ("short intro") associated with the section. Also included is a separator 557 between the two sections shown, including the "short intro" section and the "main 1" section. In the region 553 of the interface, a button tool is provided for selecting an introduction section, including in this example choices for a short introduction, a long introduction, and no introduction. Also, in region 554, a button tool is provided for selecting and ending section, including in this example choices for a short ending, a long ending and no ending. The interface includes an indicator 568 of a selected style. Also, an overview of the information about the song is provided in the fields 565, 566, 567, which align section assignments (565), chords (566), and bars (567) with a graphic representation of the audio file 575. The interface also includes a mode switch 560 for selecting between vocal and instrumental modes. In Vocal mode for one example system, the original recording is played along with the accompaniment. In Instrumental mode for the example being mentioned here, the original recording is not played, but the sequence of melody notes identified from the recording is played by a melody instrument (piano, flute, etc.). In one implementation the melody instruments consists of audio files each containing a single musical note, mapped across the musical keyboard so each key triggers a specified file with a specified pitch offset. Also for use in interacting with the server, the interface provides an automatic sound form button 555 as used to initiate a command to the server to do the song form processing described above. Also shown in figure a variety of other graphical constructs are provided to assist the user in interacting with the program.

The interface provides the functions of identifying the song form sections (e.g. Verse 1, Verse 2, etc.) of a song and allowing a user to manually edit the section boundaries and section types of the song structure.

The song intro and ending are special sections that are selected by using 553 and 554. There are three choices for each of these song sections. The Song Form editor gets updated according to the selection made by the user. By changing the intro and ending the overall song length and position of the vocal or melody gets adjusted accordingly.

In one example, the interface can be configured so that the Song Form can be edited by dragging any standard section type (e.g. 558) from the song section list to the Song Form editor region 572. For example, a sequence of dragging and dropping operations can be used. For example dragging to the label of a standard song section (e.g. 556) replaces the section in the song; dragging to the left of a label splits the section and inserts the new song section at the left; and dragging to the right of the section label in the song form editor behaves accordingly. The type of a standard song section in the song form editor can also be changed by clicking on the label of a section (e.g. 556) and selecting the new section type from a dropdown list. The length of a song section can be changed by dragging the separating line between two song sections (e.g. 557) left or right. The neighbor section will be shortened accordingly unless it is an intro or ending in which case the length cannot be altered.

A standard section in the Song Form editor can be selected by clicking it with the mouse. A selected standard section can be deleted by clicking a delete icon that appears when a section is selected. Removing a standard section in one interface embodiment will not affect the song length but merge the section to be deleted with its neighbor standard section. Controls can be implemented to limit some kinds of operations by a user. For example, a rule can require that if there is only one standard section left it cannot be deleted.

FIG. 4A presents one screen of the graphic user interface used for music composition in a representative system. Additional screens are part of the graphic user interface, and support other functions associated with automated music composition are shown in FIGS. 4B to 4F.

Figure 4B:
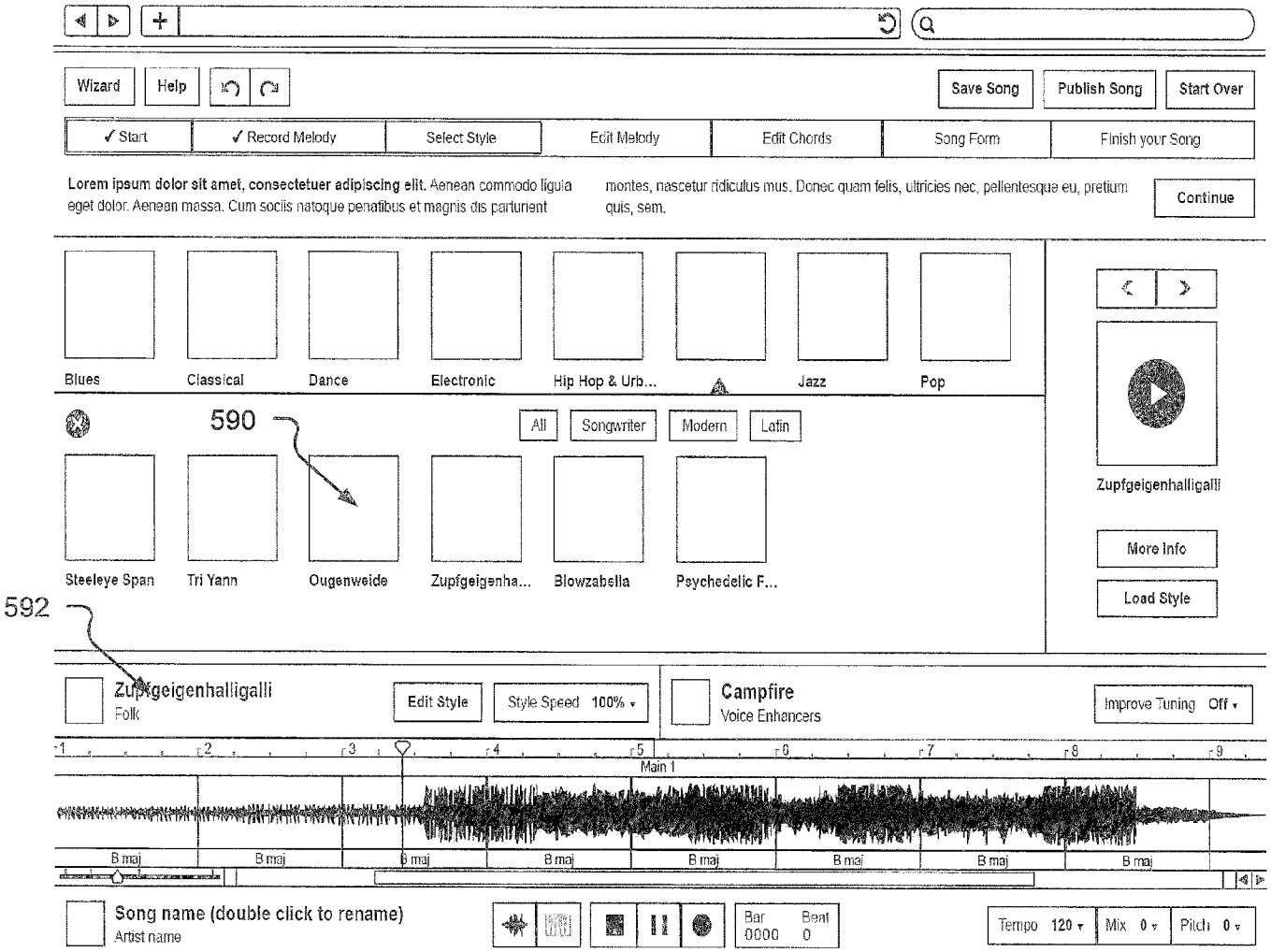

FIG. 4B shows a Select Style page of the interface. In this page a style is selected and loaded into the song by dragging a style widget 590 to the style area 592 in the song overview. The style browser can be sorted by genre and can be filtered by sub-genres. Additionally a detail field on the right hand side of the editor provides further detail and a preview of the currently selected style.

Figure 4C:
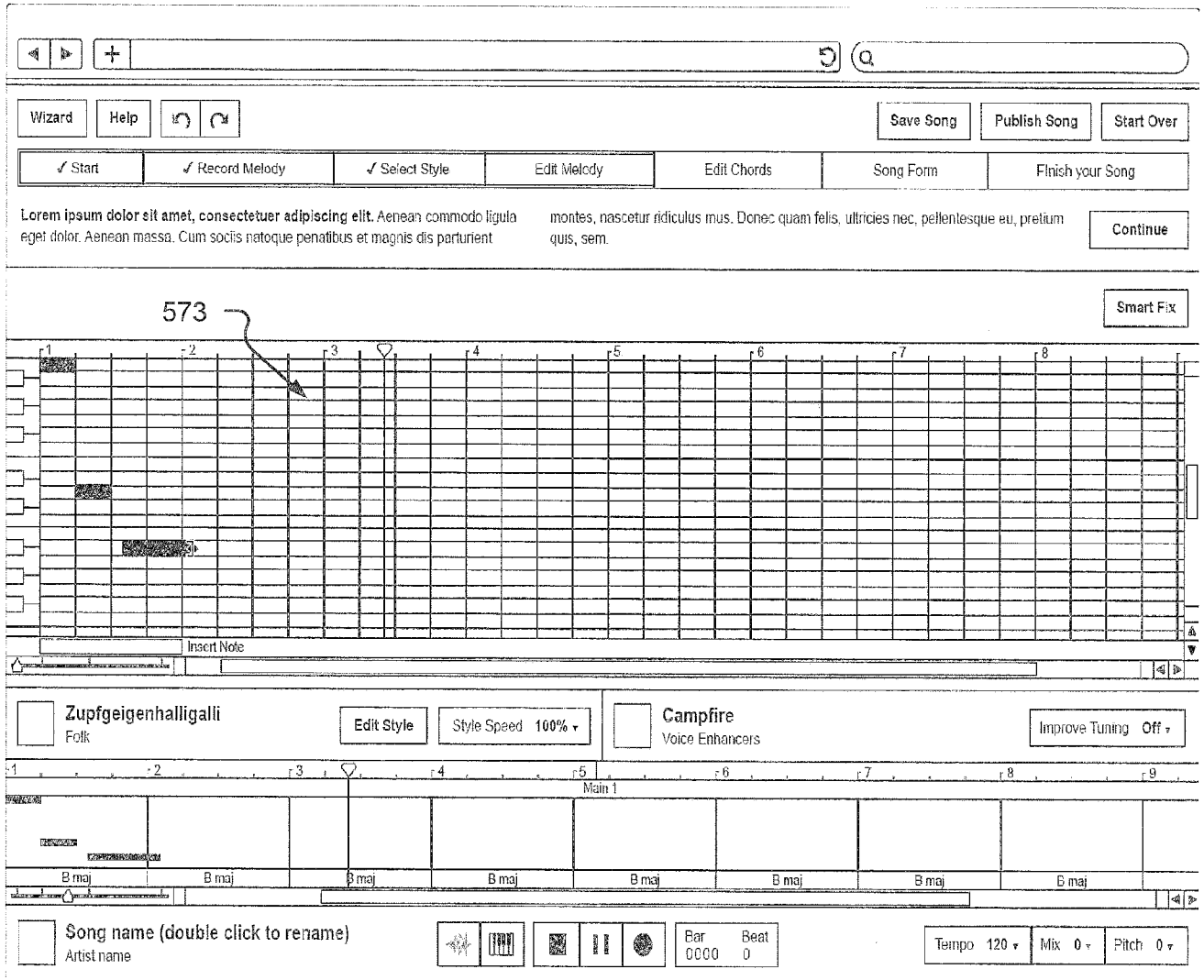

FIG. 4C shows an Edit Melody (instrument mode) page of the interface. When the user opted to have his vocal converted into a melody (using the switch at the bottom of the page below the song overview area) he can edit this melody in a piano-roll based note editor 573. He can create new notes, edit notes in pitch and length and cut, copy and paste selections.

Figure 4D:
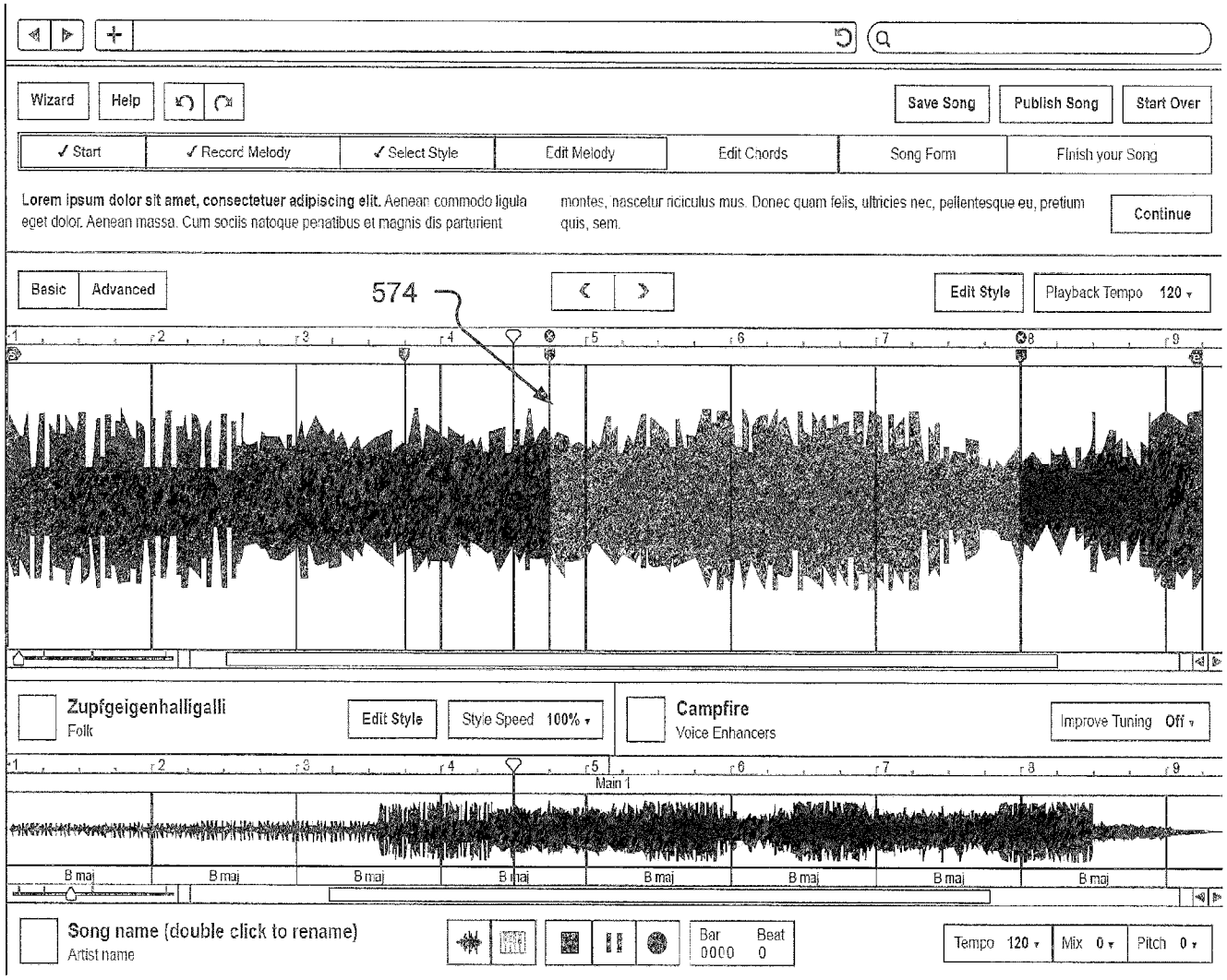

FIG. 4D shows an Edit Melody (vocal mode) page of the interface. In this screen the user can edit the timing of his vocal recording to adjust the timing against the style playback. He can either edit the start point to change the offset (basic mode) or create markers (574) and edit the length of the segment between two adjacent markers (advanced mode). In advanced mode time stretching and time compression can be applied to change the length of a segment.

Figure 4E:
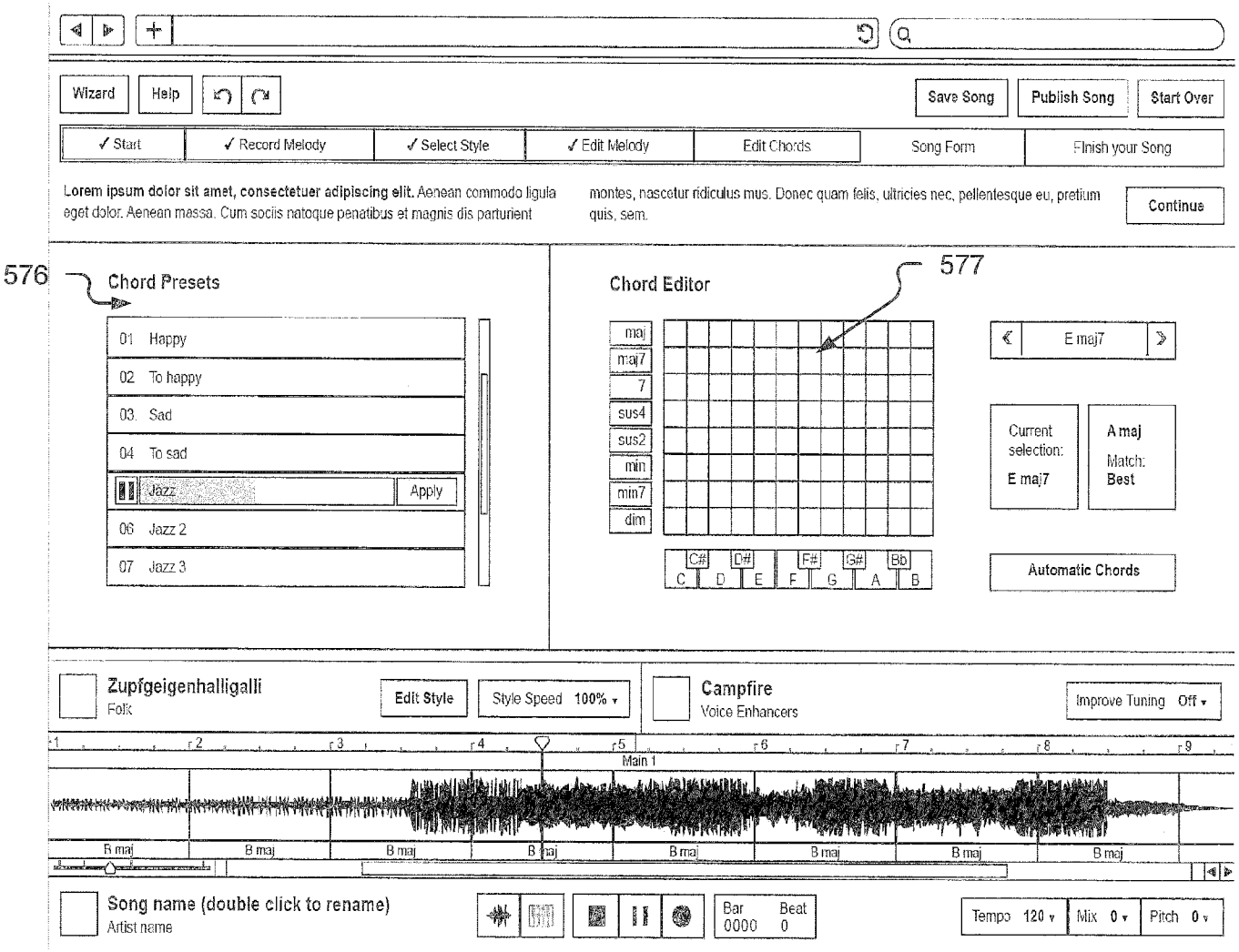

FIG. 4E shows an Edit Chords page of the interface. In this screen the user either selects a chord style (576) for an entire song on the left hand side of the workspace or changes any selected chord by using the chord matrix 577 on the right hand side of the workspace. Chords are selected by clicking them in the overview or using the left/right arrows next to the chord matrix. The user can go back to the initial chord suggestion by clicking "Automatic Chords" at any time.

Figure 4F:
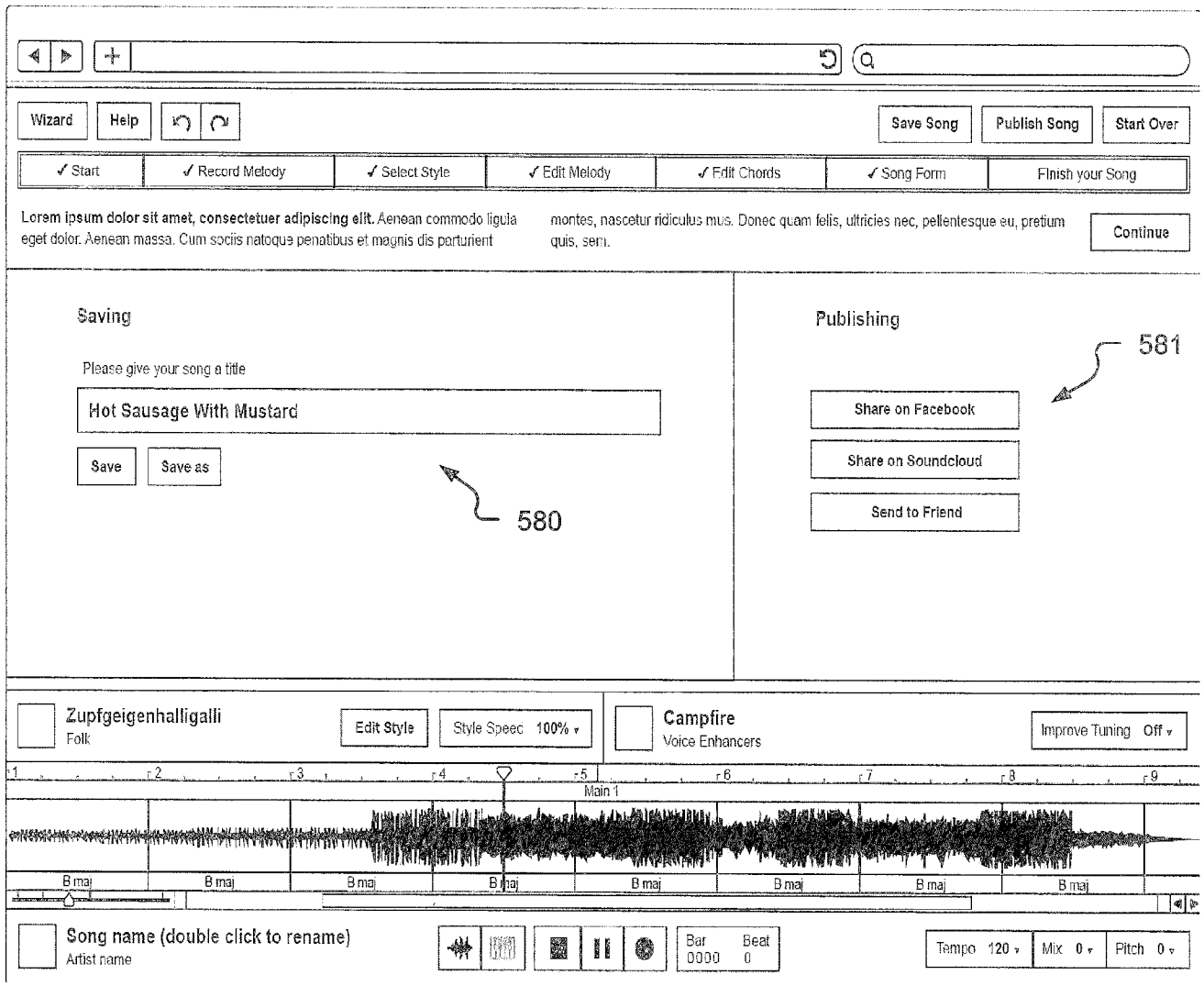

FIG. 4F shows a Finish Song (Saving & Sharing) page of the interface. In this screen the user either saves the song to a new slot in his saved songs list (580) or overwrites the song he edited. When a song has been saved successfully he can use the options (581) on the right hand side of the workspace to upload his finished song to a destination via the network.

As mentioned above, an audio recording is associated with metadata that characterizes the song. The audio recording can be associated with metadata using a variety of standard data processing techniques, including appending the data structure to the audio data file as a header or trailing section. Also, the audio recording can be associated with metadata by recording the metadata in a database keyed by a name of the audio recording. A variety of other techniques can be utilized to form the association, so that the metadata is linked to the audio recording for the purposes of data processing.

In FIG. 5 illustrates the data structure to be associated with an audio recording, which identifies the sections and section types for a melody in the recording. The data structure has a form providing a first field "Name" which identifies the name of the audio recording, or the section of the audio recording, with which the metadata is associated. The data structure form includes a second field "Section_type", which identifies the section type for a corresponding section in the melody. When the section type is "not set", then the section type has not been assigned and the metadata is associated with the whole recording.

The data structure includes a third field "Tempo" which indicates the tempo of the melody. The data structure includes a fourth field "Beats_per_bar" which identifies the length of a bar in quarter notes in this example. The data structure includes a fifth field "Key" which indicates that key of the melody using the integers which map to members of a set of available keys. The data structure includes a final field "Chords" which comprises a list of the number of beats and the name of the chord for all the chords in the sequence.

In alternative implementations, different data structure organizations can be utilized. For example, in the illustrated structure, the chord sequences are associated with each section. In other implementations, the chord sequence for an entire song can be stored in a separate data structure; and in the data structure associated with each section, an indicator of the length of the section measured in beats or in the number of chords could be provided.

Storing chords with each section has the advantage of making editing operations such as inserting or deleting a section easier to implement.

According to this example data structure, an initial song before a song form is applied could look like FIG. 6, where the section type is "Chord 1" (or another default value, such as "not set") and the "chords" field includes all of the chords in the song. After Song form is applied each section will be associated with a corresponding structure like that of FIG. 7. In FIG. 7, the song of FIG. 6 has been divided into four sections, including a "intro" section, a "verse" section, a "chorus" section, and a "ending" section. Each of the four sections has a key identified by the integer "0." The 16 bars of the melody shown in FIG. 6 are divided into the verse and chorus sections. A one bar intro has been added, and a four bar ending has been added.

FIG. 8 represents a data structure for metadata characterizing entries in a musical style library. The structure includes a "Name" field for the style overall as displayed to the user. In addition, the structure includes a field "description, genre, decade, keywords . . . " in which text is used to provide metadata for sorting, filtering, selecting styles, and in support of a graphic interface for that purpose.

In the style, there will be a number of instruments that can be played. For each instrument in the style, there is set of fields that apply to the instrument independent of the phrase, including a "Name" field for the instrument. A "Type" field for the instrument is used to hold metadata for sorting, filtering, selecting style instruments. A "Retrigger" field includes a control flag indicating whether phrases should restart on each new chord.

Each instrument in the style is associated with a "ChordMask" field using this data structure. The "ChordMask" field provides a bit mask over a list of chord types {maj, min, maj7, min7, 7, dim, sus4, sus2}, where the bit mask indicates the chords that can be played using the instrument. Instruments with no pitch such as drums will have a ChordMask of 0 to indicate that the instrument does not need to follow the chord sequence. Some instruments (typically bass instruments) only need to support a few chord types to be able to play along with any other chord, reducing the amount of audio material required. If the chord sequence contains a chord not supported by the instrument, the best matching available chord can be played instead.

Each instrument in the style is associated with a "BassNotChord" field using this data structure. Chords may have a "pedal bass" note which is different to the root note of the chord, for example Cmaj/E is a C Major chord with an E bass note. Instruments tagged with BassNotChord=1 should play the bass note, and other instruments (BassNotChord=0) should ignore the bass note.

Each instrument in the style includes a set of phrases that can be played, associated with a specific song section type using this data structure. The data structure includes a "Phrase" field which carries an integer that corresponds with one of the available phrases. The data structure includes "Start_level" and "End_level" fields, which carry values that specify the playback volume for the instrument at the start and end of the song section, allowing fade-ins, fade-outs, or any fixed or ramping volume to be achieved. The data structure includes "Trig_phrase" and "Trig_beat" fields. Optionally, a phrase can be specified to play once, either at the start of the song section (typically used for crash cymbals) or starting a specified number of quarternote beats before the end of the section, overriding the phrase that was playing until that point (typically used for drum fills). The "trig_phrase" and "trig_beat" fields provide metadata specifying the functions.

The data structure for the style also includes links to audio sources to play the selected phrases using the parameters assigned to the phrase. The phrases can be prerecorded audio clips, synthesizer loops, or other types of audio data sources.

A style library which is utilized to produce a composition in response to song section type can be created by defining a plurality of styles using a data structure such as that of FIG. 8. The data structure for a style library comprises data executable to generate musical phrases according to song form section types for accompaniment with corresponding songs. A style library can then be utilized in music composition automation machine, that characterizes an underlying melody according to song form and other song structures, including chords, notes, tempo and so on.

FIG. 9 represents a style library 900 stored in a computer readable memory 901. The computer readable memory can comprise an element of the storage subsystem of the system shown in FIG. 1, or other type of data storage medium usable by a computer system in music composition automation. Also, the style library can be distributed as a prerecorded file on a portable medium, or delivered as an electronic file for storage on a client system.

In one embodiment, the music composition automation system includes technology for extracting information about at melody, from an audio file created or selected by a user, that has not been associated with metadata identifying the melody, and characteristics of the melody. In this case, such metadata can be deduced from processing the audio file.

An input audio file can be provided. The user can provide a tempo value along with the recording, or as mentioned above the tempo can be deduced from the recorded audio data.

In one process for deducing characteristics of an audio file, the audio signal is passed through steep highpass and lowpass filters to remove frequencies outside the range of speech and most musical instruments that would otherwise interfere with the accuracy of the subsequent measurements. The filtered signal is then downsampled to reduce the computational load of the following calculations: The peak level is measured every 10 ms and also an autocorrelation is calculated to give the most likely pitch period and periodicity (to what extent is the local signal strongly pitched rather than random/noisy or a mixture of multiple pitches). Interpolation is used so the exact period and height of peaks in the autocorrelation are known and the highest peak found. Alternatively or additionally a harmonic product spectrum can be calculated by using a STFT to calculate the spectrum and multiplying the spectrum by multiples of itself (i.e. the level at each frequency gets multiplied by the spectrum level at 2.0 and 3.0 times that frequency) resulting in spectral peaks at the fundamental frequency of any input pitches—this method gives more robust pitch measurements than autocorrelation in the presence of noise or multiple pitches, but is less accurate than autocorrelation for clean monophonic signals.

When the recording has finished, the level and periodicity measurements in each 10 ms window are used to decide which sections of the analysis correspond to singing and which sections are background noise. Large and fast drops in level are assumed to be the start of background noise, even if the signal does not fall to as low a level as the background noise in other parts of the recording, to guarantee that deliberate short gaps between sung notes are not lost. The pitch period measurements in the time windows are converted to values representing semitones (middle C has the value 60.0 for compatibility with MIDI). In case the singing is out of tune relative to standard tuning, an offset is calculated that minimizes the mean squared difference from all measured pitches to the standard pitch of the nearest semitone. This offset is added to all pitches to bring them into tune. Because recordings are typically short, tuning is assumed to have the same offset throughout rather than drifting during the course of the recording.

The continuous pitch track is deleted at obvious pauses (where the audio level is low or the signal is not strongly pitched) and then tidied so there are no very short regions of pitch or silence. Each region with a continuous pitch track must consist of one or more notes, so each region is examined for significant changes in pitch which could be transitions between notes. Transitions which return close to the original pitch within a certain time window (half a period or the lowest vibrato rate, around 4 Hz) are ignored as vibrato or unintentional random variation. The continuous pitch track is then split at the note transitions, and the pitch of each continuous region is calculated as the average of all contained pitches. This usefully averages out vibrato and notes that sweep in pitch rather than sitting at a steady pitch, but if the region does not contain a pitch close to the average pitch then it must consist of more than one note and should be split again, or for short notes the final pitch can be taken as a more likely intended pitch for the note. While vibrato is ignored by the above method it is useful to know when vibrato is present. If local maxima and minima alternate and are between half a cycle at 4-8 Hz apart, then the difference between the maximum and minimum pitch is the vibrato amplitude.

For additional error detection and correction, if the pitch track increases or decreases near-monotonically for more than a certain distance (say 1.5 semitones) it is likely to be a deliberate transition between notes, so the pitch track can be split at the midpoint of the transition, and assigned to the preceding or following steady pitch. Regions of vibrato can be identified if the pitch varies with an approximately sinusoidal shape at a rate between 4 and 8 Hz. If the pitch alternates up and down at this rate the whole region can have smoothing applied to reveal any underlying long-term pitch variation—the crucial decision is whether vibrato is superimposed on a steady pitch, or on a pitch glide or transition of 1 or 2 semitones which is otherwise invisible if the amplitude of the vibrato is greater than the transition.

At this point the regions represent a series of notes positioned in time. Next the tempo and barline positions are considered in order to align the notes to a timing grid. The note start positions are compared to a series of grids, from 120 to 450 divisions per minute. For each grid an offset is calculated that minimizes the mean squared difference between note start positions and the nearest grid position. The grid with the lowest MSD will therefore have grid positions close to many of the note start positions and is assumed to be a good match. Next it needs to be decided if one grid interval represents a quarternote, eighth-note, or some other musical note length, from which the tempo can be calculated. Lastly, given a bar length (typically 3 or 4 quarternotes per bar), a grid position is chosen to represent the first barline such that more note star positions are closer to barlines than any other grid position.

There are many assumptions in the above process and the result is not always accurate, so the user is given the chance to adjust the offset and speed of the recording/melody relative to a metronome and graphic display of beat and bar positions, and also to correct or delete individual melody notes, before song structure is generated.

In some embodiments, automatic chord assignment processes can assign chords to bars in the melody in support of the process of assigning sections and section types, and of the process of selecting accompaniment. Also, chord assignments can be edited or created by users of the program.

Automatic chord assignment processes can include creating a histogram of the notes present in each bar of the melody, and comparing the histogram to a set of pre-prepared histograms representing the most likely melody notes that would normally be accompanied by each candidate chord. The set of candidate chords are chosen based on the key of the melody. The best matching chord (using least squared difference between the histograms, or some other measure) is then selected for each bar.

Optionally, if the same chord is selected a number of times (e.g. 3) consecutively, the middle occurrence can be replaced by the second best matching chord to make the chord sequence more interesting.

For some styles of music such as Jazz, it is desirable to substitute each of the selected chords with a more complex, colorful chord using a lookup table.

While the present invention is disclosed by reference to the preferred embodiments and examples detailed above, it is understood that these examples are intended in an illustrative rather than in a limiting sense. Computer-assisted processing is implicated in the described embodiments. Accordingly, the present invention may be embodied in methods for perform processes described herein, systems including logic and resources to perform processes described herein, systems that take advantage of computer-assisted methods for performing processes described herein, media impressed with logic to perform processes described herein, data streams impressed with logic to perform processes described herein, or computer-accessible services that carry out computer-assisted methods for perform processes described herein. It is contemplated that modifications and combinations will readily occur to those skilled in the art, which modifications and combinations will be within the spirit of the invention and the scope of the following claims.

What is claimed is:

1. A music composition automation method comprising:

storing an audio recording including a melody;

processing the audio recording using a computer program which divides the melody into sections, and assigns metadata which identifies song form section types for the sections; and associating audio accompaniment with the sections based on the identified section types by processing the assigned metadata.

2. The method of claim 1, including using a computer program to assign metadata identifying chords for corresponding bars in the melody, and said associating audio accompaniment is responsive to the identified chords.

3. The method of claim 1, including:

storing a style library including data executable to generate musical phrases, musical phrases in the style library being associated with metadata linking the corresponding phrases with musical styles, and specifying characteristics of the corresponding phrases according to section types; and selecting musical phrases for said audio accompaniment from the style library using a computer program in response to the section types based on the assigned metadata.

4. The method of claim 1, wherein the audio recording is associated with metadata identifying chords for corresponding bars in the melody, and including:

storing a style library including data executable to generate musical phrases, musical phrases in the style library being associated with metadata linking the corresponding phrases with musical styles, and specifying characteristics of the corresponding phrases according to section types and chords; and selecting musical phrases for said audio accompaniment from the style library using a computer program in response to the section types and the chords based on the assigned metadata and the metadata identifying chords.

5. The method of claim 1, wherein the assigned metadata groups bars into said sections, and including:

providing an interface displaying the sections and identified section types based on the assigned metadata; and accepting commands via the interface to edit the metadata grouping bars into said sections, including for a particular one of said sections, commands to change a beginning bar and commands to change an ending bar.

6. The method of claim 1, including:

providing an interface displaying the sections and identified section types; and accepting commands via the interface to edit the metadata to change the section type associated with a particular one of said sections.

7. The method of claim 1, including:

providing an interface displaying the sections and identified section types based on the assigned metadata; and accepting commands via the interface to add at least one of an introduction section including one or more bars, and an ending section including one or more bars, to the melody; and associating audio accompaniment with said at least one of the introduction section and the ending section.

8. The method of claim 1, wherein the assigned metadata groups bars into said sections, and including providing an interface to a remote client over a communication network, and accepting commands to edit metadata grouping bars in the melody into sections, and to identify song form section types for the sections, via the interface.

9. The method of claim 1, wherein the computer program which divides the melody into sections assigns metadata to the audio recording to group bars in the melody into the sections, and to identify song form section types for the sections using logic based on a rule related to numbers of bars in typical song form sections.

10. The method of claim 1, including processing the audio file to identify characteristics of notes in the melody, and wherein the computer program which divides the melody into sections assigns metadata to the audio recording to group bars in the melody into sections, and to identify song form section types for the sections using logic based on said characteristics of notes.

11. The method of claim 1, including rendering a composed audio file including a composition of the melody and the audio accompaniment.

12. The method of claim 1, including generating sound using a composition of the melody and the audio accompaniment.

13. An apparatus comprising:

a data processing system including a processor and memory, and an audio recording stored in the memory including a melody, the data processing system including logic which processes the audio recording to divide the melody into sections, and to assign metadata which identifies song form section types for the sections, and logic to associate audio accompaniment with the sections based on the identified section types by processing the assigned metadata.

14. The apparatus of claim 13, the data processing system including logic to assign metadata identifying chords for corresponding bars in the melody, and said logic to associate audio accompaniment is responsive to the identified chords.

15. The apparatus of claim 13, including:

a style library stored in memory accessible by the data processing system, the style library including data executable to generate musical phrases, musical phrases in the style library being associated with metadata linking the corresponding phrases with musical styles, and specifying characteristics of the corresponding phrases according to section types; and logic to select musical phrases for said audio accompaniment from the style library in response to the section types based on the assigned metadata.

16. The apparatus of claim 13, wherein the audio recording is associated with metadata identifying chords for corresponding bars in the melody, and including:

a style library including data executable to generate musical phrases, musical phrases in the style library being associated with metadata linking the corresponding phrases with musical styles, and specifying characteristics of the corresponding phrases according to section types and chords; and logic to select musical phrases for said audio accompaniment from the style library in response to the section types and the chords based on the assigned metadata and the metadata identifying chords.

17. The apparatus of claim 13, wherein the assigned metadata groups bars into said sections, and including:

logic to provide an interface displaying the sections and identified section types based on the assigned metadata, and accept commands via the interface to edit the metadata grouping bars into said sections, including for a particular one of said sections, commands to change a beginning bar and commands to change an ending bar.

18. The apparatus of claim 13, including:

logic to provide an interface displaying the sections and identified section types based on the assigned metadata; and accept commands via the interface to edit the metadata to change the section type associated with a particular one of said sections.

19. The apparatus of claim 13, including:

logic to provide an interface displaying the sections and identified section types, and accept commands via the interface to add at least one of an introduction section including one or more bars, and an ending section including one or more bars, to the melody; and logic to associate audio accompaniment with said at least one of the introduction section and the ending section.

20. The apparatus of claim 13, wherein the assigned metadata groups bars into said sections, and including logic to provide an interface to a remote client over a communication network, and accept commands to edit the metadata grouping bars in the melody into sections, and to identify song form section types for the sections, via the interface.

21. The apparatus of claim 13, including logic to identify song form section types for the sections using logic based on a rule related to numbers of bars in typical song form sections.

22. The apparatus of claim 13, including logic to process the audio recording to identify characteristics of notes in the melody, and to identify song form section types for the sections using logic based on said characteristics of notes.

23. The apparatus of claim 13, including logic to render a composed audio file including a composition of the melody and the audio accompaniment.

24. The apparatus of claim 13, including a transducer to produce sound using a composition of the melody and the audio accompaniment.

25. An apparatus comprising:

a style library stored in memory readable by a data processing system, the style library including data executable by a data processing system to generate musical phrases associated with respective styles, musical phrases in the style library including metadata specifying characteristics of the phrase according to song form section types.

26. The apparatus of claim 25, wherein the musical phrases in the style library include metadata specifying characteristics of the phrase according to chords.

* * * * *